United States Patent [19]

Webb

[11] 4,385,440

[45] May 31, 1983

[54] CUTTING APPARATUS

[76] Inventor: Harry T. Webb, 411 W. 5th St., San Dimas, Calif. 91773

[21] Appl. No.: 229,638

[22] Filed: Jan. 29, 1981

[51] Int. Cl.[3] ..... B26B 29/00

[52] U.S. Cl. ..... 30/294; 30/330; 30/DIG. 3

[58] Field of Search ..... 30/2, 291, 294, 330, 30/331, 335, DIG. 3

[56] References Cited

U.S. PATENT DOCUMENTS

| | | | |
|---|---|---|---|
| 2,487,624 | 11/1949 | Wiggers | 30/331 X |
| 3,678,581 | 7/1972 | Bolduc | 30/294 |
| 3,820,240 | 6/1974 | Witsell | 30/294 |

FOREIGN PATENT DOCUMENTS

| | | | |
|---|---|---|---|
| 566233 | 12/1944 | United Kingdom | 30/294 |

*Primary Examiner*—James G. Smith

*Attorney, Agent, or Firm*—Boniard I. Brown

[57] ABSTRACT

Apparatus for cutting a sheet of material which includes a base member having a generally planar top surface and a body member having a generally planar bottom surface. The body member has a first slot extending from the bottom surface. A spacer separates the top surface of the base member and the bottom surface of the body member. A bifurcated retainer has first and second generally parallel generally coplanar arms which are disposed respectively in first and second planes passing on first and second sides of the first slot. In some forms of the invention the apparatus includes a cover element and a pivotal mounting for the cover element on the body member. The cover element may have a notch therein for receiving a corner of an associated cutting edge. The pivotal mounting may include a spring bias for urging the cover element toward the body member. The bifurcated retainer may be manufactured of spring steel.

13 Claims, 4 Drawing Figures

CUTTING APPARATUS

BACKGROUND OF THE INVENTION

The invention relates to cutting apparatus and particularly to apparatus for cutting sheet materials such as paper, plastics and the like. Foodstuffs such as potato chips, peanuts and the like are typically packed in small bags which are often difficult to open. The problem of opening such containers is particularly acute for the very young, the very old, and others with physical disabilities.

Although the invention has particular application to the opening of such bags, it will be understood to also have application to the cutting of sheet material generally.

Many devices have been proposed for the cutting of such materials. One such device is disclosed in U.S. Pat. No. 2,091,337 which utilizes a razor blade carried in a housing which is supported on a roller. Devices of the type described in this patent are not satisfactory because the cutting edges are left exposed when the apparatus is not in use and thus are hazardous.

It is a primary object of the invention to provide apparatus which will easily and rapidly cut a piece of sheet material such as that used to manufacture a bag.

It is another object of the invention to provide apparatus which may be safely used even by children.

Another object of the invention is to provide apparatus in which it is easy to replace the cutting edge.

Still another object of the invention is to provide apparatus which is simple and inexpensive to manufacture.

SUMMARY OF THE INVENTION

The foregoing objects and other objects and advantages which shall become apparent from the detailed description of the preferred embodiment are attained in an apparatus which includes a base member having a generally planar top surface and a body member having a generally planar bottom surface. The body member has a first slot extending from the bottom surface. A spacer separates the top surface of the base member and the bottom surface of the body member. A bifurcated retainer has first and second generally parallel, generally coplanar arms, the arm being extending through respectively first and second planes passing on first and second sides of the first slot.

In some forms of the invention a cover element is pivotally mounted on the body member. The cover element may have a notch therein for receiving a corner of an associated cutting edge. The means for pivotally mounting may include a spring base for urging the cover element toward the body member. The bifurcated retainer may be manufactured of spring steel.

The base member may be provided with a recess in the top surface thereof. The bifurcated retainer may be mounted on the base member in the recess. The body member may be elongated. The body member may have axially extending grooves on opposed sides thereof for cooperation with the fingers of a user. The spacer means may be an integral part of the base member. The body member may have at least one axial extremity having a prow shaped contour.

The apparatus may include means for allowing replacement of the associated cutting edge. The apparatus may include a cutting edge and the cutting edge may be a single edge razor blade. The apparatus may further include means for hanging on an associated wall. The means for hanging may include at least one eye. The bifurcated retainer may be fixed to one of the members and may contact the other of the members.

BRIEF DESCRIPTION OF THE ACCOMPANYING DRAWING

DESCRIPTION OF THE PREFERRED EMBODIMENT

Figure 3:
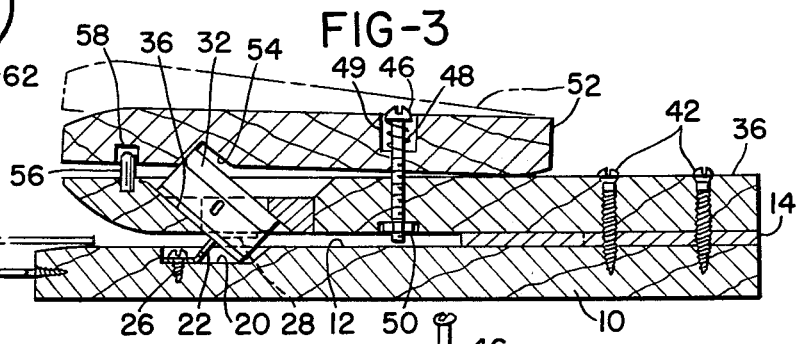
FIG. 3 is a sectional view taken along the line 3—3 of FIG. 2.
Figure 4:
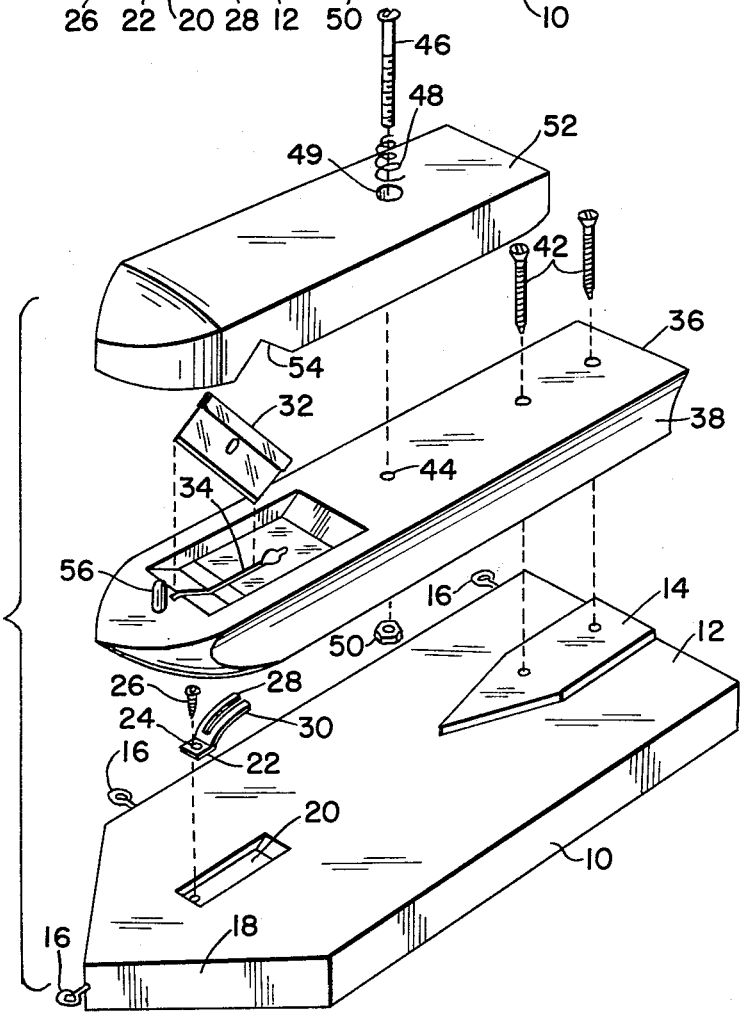
FIG. 4 is a perspective view of the apparatus illustrated in FIGS. 1–3 with the parts thereof disposed in exploded relationship.

Referring now to FIGS. 1–4 there is shown a base member 10 having a generally planar upper or top surface 12. A spacer member 14 may be an integral part of the base member 10 or may be a discrete element. A plurality of eyes 16 are disposed along the side of the base member 10 as well as at the pointed end 18 of the base member 10. A recess 20 is, in the preferred form, elongated and disposed with the axis thereof coincident with the axis of the elongated base member 10. Mounted in the recess 20 is a bifurcated element 22 having an opening 24 which cooperates with a screw 26. The bifurcated element 22 includes first and second fingers or legs 28, 30 which are generally parallel and which are disposed respectively in planes (not shown) extending on opposite sides of a single edge razor blade 32 which is carried in a slot 34 of a body member 36. The slot 34 has the right axial extremity (as viewed in FIGS. 3 and 4) enlarged to accommodate the upper edge of the razor blade 32. This relationship is best illustrated in FIG. 3.

Figure 1:
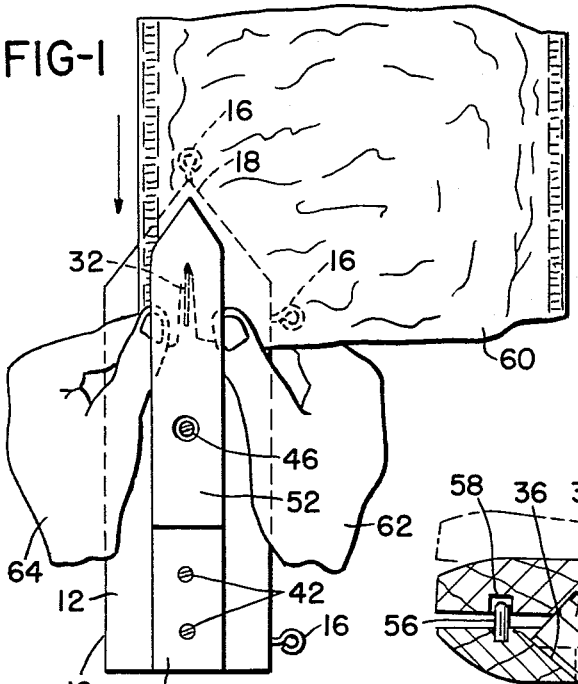
FIG. 1 is a broken away plan view illustrating the apparatus in accordance with the invention being used to cut the top of a bag.
Figure 2:
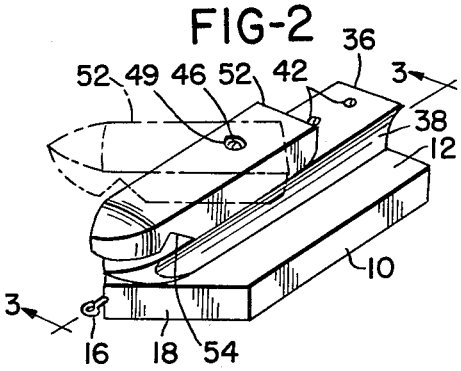
FIG. 2 is perspective view of the apparatus illustrated in FIG. 1.

The body member 36 is elongated and is provided with grooves 38 (one shown) on each side thereof to cooperate with the thumbs of the user as best illustrated in FIG. 1. The left extremity of the body member 36 (as viewed in FIG. 3) is generally prow shaped. Ordinarily the body member 36 will be rigidly attached to the base member 10 by means of screws 42, 42. The body member 36 is provided with a through hole 44 which cooperates with a bolt 46, coil spring 48, and nut 50 to pivotally mount a cover element 52. The cover element has a notch 54 which cooperates with one corner of the single edge razor blade 32. The head of the bolt 46 and spring 48 are disposed in a counterbore 49 in the cover element 52. A pin 56 is mounted in the body member 36 proximate to the left (as viewed) axial extremity of the slot 34.

The pin 56 cooperates with a blind hole 58 in the cover element 52. As best seen in FIG. 3 the cover element 52 may be raised at the left axial extremity thereof against the bias of the spring 48 to disengage it from the pin 56. Thereafter the cover element 52 may be pivoted about the bolt 46 to the position illustrated in phantom in FIG. 2. With this position of the cover element 52 the single edge razor blade 32 may be easily removed from the slot 34 and replaced. The operation of the apparatus is best illustrated in FIG. 1. The apparatus may be bolted down on a horizontal surface or may be hung by the eyelet 16. For example, an eye or eyelet 16 disposed at the end 18 of the base member 10 may be used to hang the apparatus with the end 18 uppermost. The user grasps the bag 60 with his hands 62, 64 and pulls the bag with the portion thereof intermediate his hands 62, 64 in a taut condition intermediate the bifurcated member or retainer 22 and the bottom of the body member 36. This pulling continues until the bag 60 contacts the blade 32 to initiate cutting. The user may then continue pulling the bag 60 by moving his hands 62, 64 with the thumbs thereof bearing against the grooves 38, 38 on the sides of the body member 36. Once the initial cut is started, with the combination of the taut holding of the bag 60 by the hands 62, 64 and the positioning by the bifurcated member 22 continued cutting is relatively easy.

In various embodiments of the invention the base member 10, body member 36, and cover element 52 may be manufactured of wood or plastic. The space member 14 may be an integral part of the body member 14.

It will thus be seen that the apparatus in accordance with the invention may be operated safely even by children. Similarly the apparatus makes it easy to start and complete a cut in a piece of sheet material such as that typically used for snack containers. The cutting edge may be easily replaced. It will also be apparent that the apparatus is simple and inexpensive to manufacture.

The invention has been described with reference to its illustrated preferred embodiment. Persons skilled in the art of construction cutting apparatus may upon exposure to the teachings herein, conceive variations in the mechanical development of the components therein. Such variations are deemed to be encompassed by the disclosure, the invention being delimited only by the appended claims.

The inventor claims:

1. Apparatus for cutting sheet material by cutting edge means thereon, comprising:

a cutting element defining said cutting edge means and comprising a single edge razor blade, a base member having a generally planar top surface and defining a recess in said surface, a body member having a generally planar bottom surface, said body member having a slot extending from said bottom surface and having at least one axial extremity having a prow shaped contour, said body member being elongated and having axially extending grooves on opposed sides thereof for cooperation with the fingers of a user, spacer means for separating said top surface of said base member and said bottom surface of said body member, a bifurcated retainer mounted in said base member recess and having first and second generally parallel coplanar arms, each of said arms extending respectively into first and second planes passing on first and second sides of said first slot, said retainer being fabricated of spring steel, and a cover element and means for pivotally mounting said cover element on said body member, said cover element defining a notch therein for receiving a corner of said cutting edge, said means for pivotally mounting including a spring bias for urging said cover element toward said body member, said cover element being movable pivotally relative to the body member and separable therefrom against said spring bias to provide access to the cutting element.

2. The apparatus according to claim 1, wherein:

said apparatus further includes means for hanging on an associated wall.

3. The apparatus according to claim 2, wherein:

said means for hanging includes at least one eye.

4. Apparatus for cutting sheet material and for holding an associated cutting element having a cutting edge, said apparatus comprising:

a base member having a top surface, a body member having a bottom surface and defining a slot extending from the bottom surface to receive the cutting element, spacer means separating said base member top surface and said body member bottom surface, a bifurcated retainer having a pair of generally parallel arms, the respective arms extending on respective sides of said slot, and a cover element pivotally mounted on the body member about an axis oriented in the general direction of the cutting edge of the cutting element.

5. The apparatus according to claim 4, and further including:

means for providing said pivotal mounting of the cover element, including spring bias means for urging the cover element toward the body member, the cover element being movable pivotally relative to the body member and in a direction to separate the cover element from the body member to provide access to said cutting element.

6. The apparatus according to claim 4, wherein:

said cover element defines a notch for receiving and positioning a portion of the cutting element.

7. The apparatus according to claim 6, wherein:

said bifurcated retainer is manufactured of spring steel.

8. The apparatus according to claim 7, wherein:

said base member has a recess defined in its top surface and intersecting said slot.

9. The apparatus according to claim 8, wherein:

said bifurcated retainer is mounted on said base member in said recess.

10. The apparatus according to claim 9, wherein:

said body member is elongated.

11. The apparatus according to claim 10, wherein:

said body member has axially extending grooves on opposed sides thereof for cooperation with the fingers of a user.

12. The apparatus according to claim 10, wherein:

said body member has at least one axial extremity having a prow shaped contour.

13. The apparatus according to claim 4, wherein:

said bifurcated retainer is fixed to one of said members and contacts the other of said members.

* * * * *